US008245644B1

(12) United States Patent
Haas

(10) Patent No.: US 8,245,644 B1
(45) Date of Patent: Aug. 21, 2012

(54) VISIBLE EMISSIONS TRAINING SMOKE GENERATING SYSTEM

(76) Inventor: Erik H. Haas, Anchorage, AK (US)

( * ) Notice: Subject to any disclaimer, the term of this patent is extended or adjusted under 35 U.S.C. 154(b) by 589 days.

(21) Appl. No.: 12/584,957

(22) Filed: Sep. 14, 2009

(51) Int. Cl.
*C06D 3/00* (2006.01)
*F42B 12/48* (2006.01)

(52) U.S. Cl. ..... 102/334

(58) Field of Classification Search ..... 102/334
See application file for complete search history.

(56) References Cited

U.S. PATENT DOCUMENTS 2,620,621 A * 12/1952 Nettel ..... 60/601
4,282,113 A * 8/1981 Kiley ..... 126/59.5
4,459,219 A * 7/1984 Kiley ..... 516/2
H000172 H * 12/1986 Pribyl et al. ..... 516/2
5,115,633 A * 5/1992 Priser et al. ..... 60/39.01
5,665,272 A * 9/1997 Adams et al. ..... 516/5
5,682,010 A * 10/1997 Embury, Jr. ..... 102/334
* cited by examiner

*Primary Examiner* — Michelle Clement
(74) *Attorney, Agent, or Firm* — Michael J. Tavella

(57) ABSTRACT

A smoke generating system that complies with the EPA's standard design criteria, which call for separate black and white smoke generation chambers, a smoke stack with exhaust fan, an electronic opacity monitor (transmissometer), and a recording device for the transmissometer data. It includes a redesigned black smoke burn chamber that can be operated on diesel fuel only, eliminating the need for toluene. The white smoke generator is improved by including an automatic temperature control circuit to maintain fuel evaporation chamber temperatures between 700 and 900 degrees F. The unit also employs an induced draft fan (injector) dilution air system. This system eliminated the prior art fan system and significantly improves the dilution air flow characteristic by establishing a gradual differential flow gradient. The entire system is mounted on a self-contained chassis that can be transported to any desired location. In addition, audio equipment installed provides amplification for the instructor during classes.

20 Claims, 7 Drawing Sheets

VISIBLE EMISSIONS TRAINING SMOKE GENERATING SYSTEM

CROSS REFERENCE TO RELATED APPLICATIONS

This application claims benefit of Provisional application 61/087,305 filed Sep. 8, 2008.

STATEMENT REGARDING FEDERALLY SPONSORED RESEARCH AND DEVELOPMENT

Not Applicable

BACKGROUND OF THE INVENTION

1. Field of the Invention

This invention relates to training simulators designed to produce both black and white smoke plumes and particularly to training simulator designed to produce both black and white smoke plumes using relatively safe materials to produce the smoke.

2. Description of the Prior Art

As part of the effort to improve air quality, programs for monitoring emissions have been put into place. Monitoring emissions involves the visual observance of smoke plumes, both black and white, in order to determine whether the smoke plume is in compliance. Compliance is measured in terms of opacity of the smoke, as compared to known opacities measured from zero to one hundred percent opacity.

Before inspectors can begin to observe, they must be trained to determine opacities. This is done using training stations that produce smoke at a known opacities and then having the trainees use that information to learn and test their skills. Today, devices exist that generate smoke under controlled conditions. Typically, they incorporate both white and black smoke generators, an exhaust stack and a fan to diffuse and mix the smoke before it enters the stack. While these systems are useful, they have some drawbacks. First, they produce black smoke using toluene, which is a highly flammable and the smoke produced is a neurologic toxin. The use of toluene constitutes a significant safety risk. The prior art units also have a radial fan configuration that is typically located between the white and black smoke generators and the stack base. This configuration limits the dilution airflow characteristic, which can produce puffing and smoke density instabilities.

BRIEF DESCRIPTION OF THE INVENTION

The instant invention is a training simulator designed to produce both black and white smoke plumes at known opacities from zero to one hundred percent. The visible emissions generator is normally employed in visible emissions training and certification programs to certify field enforcement personnel involved in visual observations of stationary source emissions.

The purpose of the instant smoke generator is to train observers to employ U.S. EPA (Environmental Protection Agency) reference Method 9 to determine the opacity of the emissions. VEGA smoke generators comply with EPA's standard design criteria, which call for separate black and white smoke generation chambers, a smoke stack with exhaust fan, an electronic opacity monitor (transmissometer), and a recording device for the transmissometer data.

The invention improves over the prior art because it uses a redesigned black smoke burn chamber that can be operated on diesel fuel only. Thus, the need for toluene is eliminated. The white smoke generator is also improved by including an automatic temperature control circuit in order to maintain fuel evaporation chamber temperatures between 700 and 900 degrees F. The unit also employs an induced draft fan (injector) dilution air system. This system eliminates the prior art fan system and significantly improves the dilution airflow characteristic by establishing a gradual differential flow gradient.

The entire system is mounted on a self-contained chassis that can be transported to any desired location. In addition, audio equipment installed provides amplification for the instructor during classes.

It is an object of this invention to create a smoke generator to train observers to employ U.S. EPA reference Method 9 to determine the opacity of the emissions.

It is another object of this invention to create a smoke generator that complies with the EPA's standard design criteria, which call for separate black and white smoke generation chambers, a smoke stack with exhaust fan, an electronic opacity monitor (transmissometer), and a recording device for the transmissometer data.

It is yet another object of this invention to create a smoke generator that utilizes a black smoke burn chamber that can be operated on diesel fuel only.

It is a further object of this invention to create a smoke generator in which the white smoke generator has an automatic temperature control circuit in order to maintain fuel evaporation chamber temperatures between 700 and 900 degrees F.

It is yet another object of this invention to create a smoke generator that employs an induced draft fan (injector) dilution air system that establishes a gradual differential flow gradient.

It is yet another object of this invention to create a smoke generator system that is mounted on a self-contained chassis that can be transported to any desired location.

It is yet another object of this invention to create a smoke generator that includes audio equipment installed on the chassis to provide amplification for the instructor during classes.

DETAILED DESCRIPTION OF THE INVENTION

Figure 1:
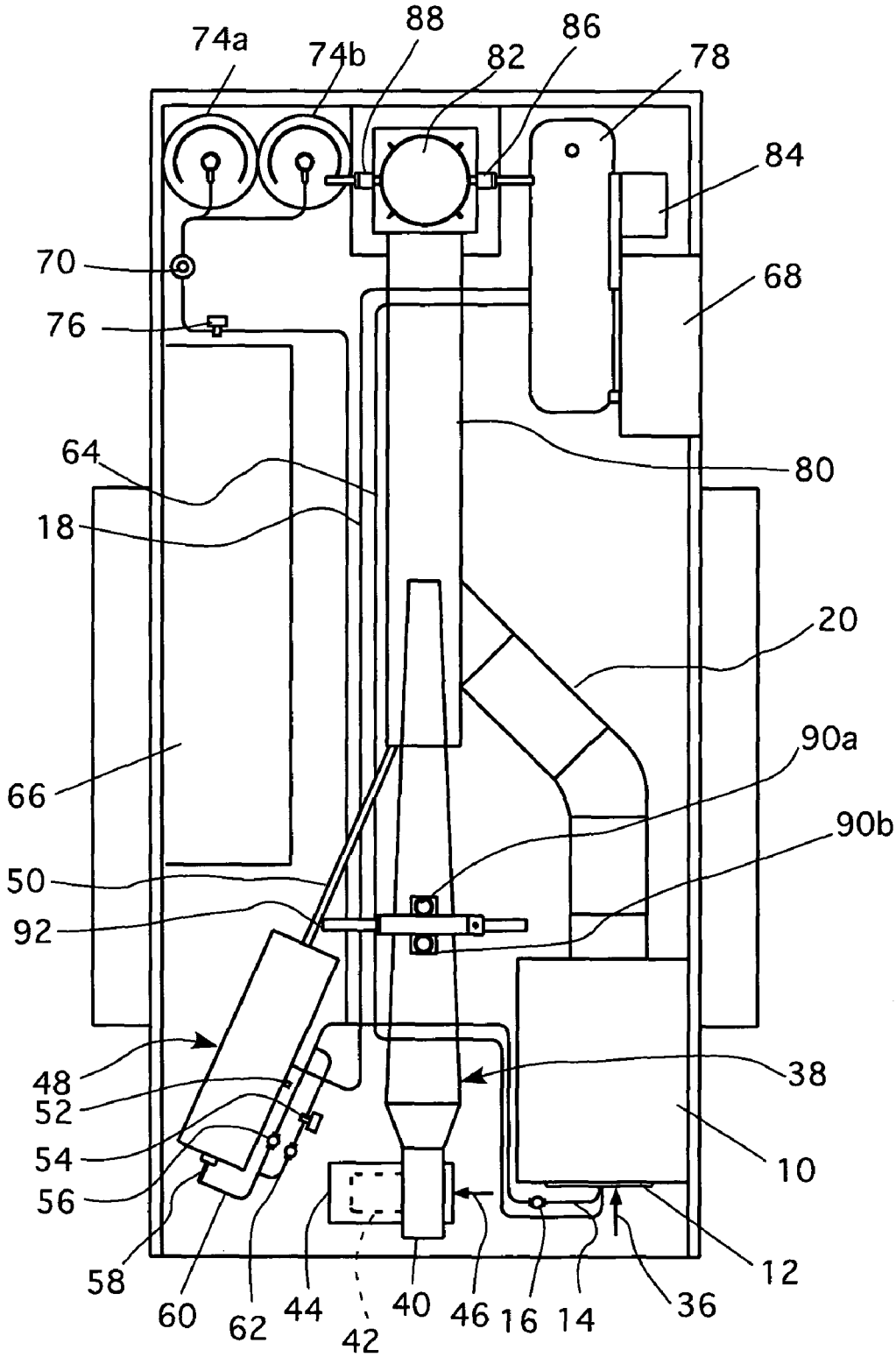
FIG. 1 is a plan view of the assembled unit.

Referring now to FIG. 1, a plan view of the assembled unit is shown. The components are mounted on a chassis 200 (see FIG. 2). The basic components of the unit include a black smoke combustion chamber 10 that has black smoke generator air inlet louvers 12. The black smoke generator is supplied by a propane line 14. There is a black smoke generator pilot light adjustment valve 16 in the fuel line as shown. The black smoke generator is also supplied with diesel fuel through a fuel line, which connects to the fuel tank 78. The output of the black smoke generator is passed through the black smoke duct 20, which connects to an intake manifold 80 that then attaches to an exhaust stack 82. The black smoke generator is supplied with air through a combustion air inlet 36. Unlike other smoke generating units, the black smoke burn chamber 10 of this invention can be operated on diesel fuel only, eliminating the need for toluene. (Toluene, due to its flammability, constitutes a significant safety risk.) The structure of the black smoke generator is discussed in detail below.

As noted above, the output of the black smoke generator is passed into an intake manifold. An induced draft air injector 38 is used to inject moving air into the exhaust manifold. The induced draft injector 38 dilution air system eliminates older radial fan configurations. This design significantly improves the dilution airflow characteristic by establishing a gradual differential flow gradient, which improves the exhaust flow stability and eliminates the traditional puffing and smoke density instabilities of older units.

The induced draft air injector 38 has a main fan 40 with a fan motor 42. The fan motor has a cover 44. Air enters the induced draft air injector 38 through a dilution air inlet 46.

The invention also includes a flow-diverter and straightening chamber located at the stack base to establish a smooth transition from horizontal duct flow to the vertical exhaust stack flow. This is discussed in detail below.

In addition to the black smoke generator, a white smoke generator is also installed on the chassis. The white smoke generator has a chamber 48 and a white smoke duct 50 as shown. The white smoke duct 50 also connects to the intake manifold 80.

The white smoke generator system also includes a temperature sensor 52, an automatic temperature control solenoid valve 54, which is used to maintain fuel evaporation chamber temperatures between 700 and 900 degrees F., and a pilot light adjustment valve 56. The white smoke generator is fed by a propane torch 58 that is supplied by a propane line 60 from propane tanks 74*a* and 74*b*. The white smoke generator also has a flame adjustment valve 62. Like the Black smoke generator, the white smoke generator also has a fuel line 18 that feeds fuel from the fuel tank 78.

The chassis 200 has several other components. A storage compartment 66 is provided for holding equipment. A control console 68 provides overall system control, as discussed below. A propane regulator 70, propane line 14, propane tanks 74*a* and 74*b*, and a propane shut-off valve 76, complete the propane system. The propane tanks 74*a* and 74*b* are independent gas cylinders that can be individually tied into the system. The pressure regulator provides even gas flow. The remote-control solenoid shutoff valve is provided in line with the pressure regulator. The diesel fuel tank 78 is positioned as shown.

Monitoring equipment, including an opacity monitor control unit 84, an opacity monitor sender unit 86, and an opacity monitor receiver unit 88 are used for readings.

Two speakers 90*a* and 90*b* are provided as well.

Figure 7:
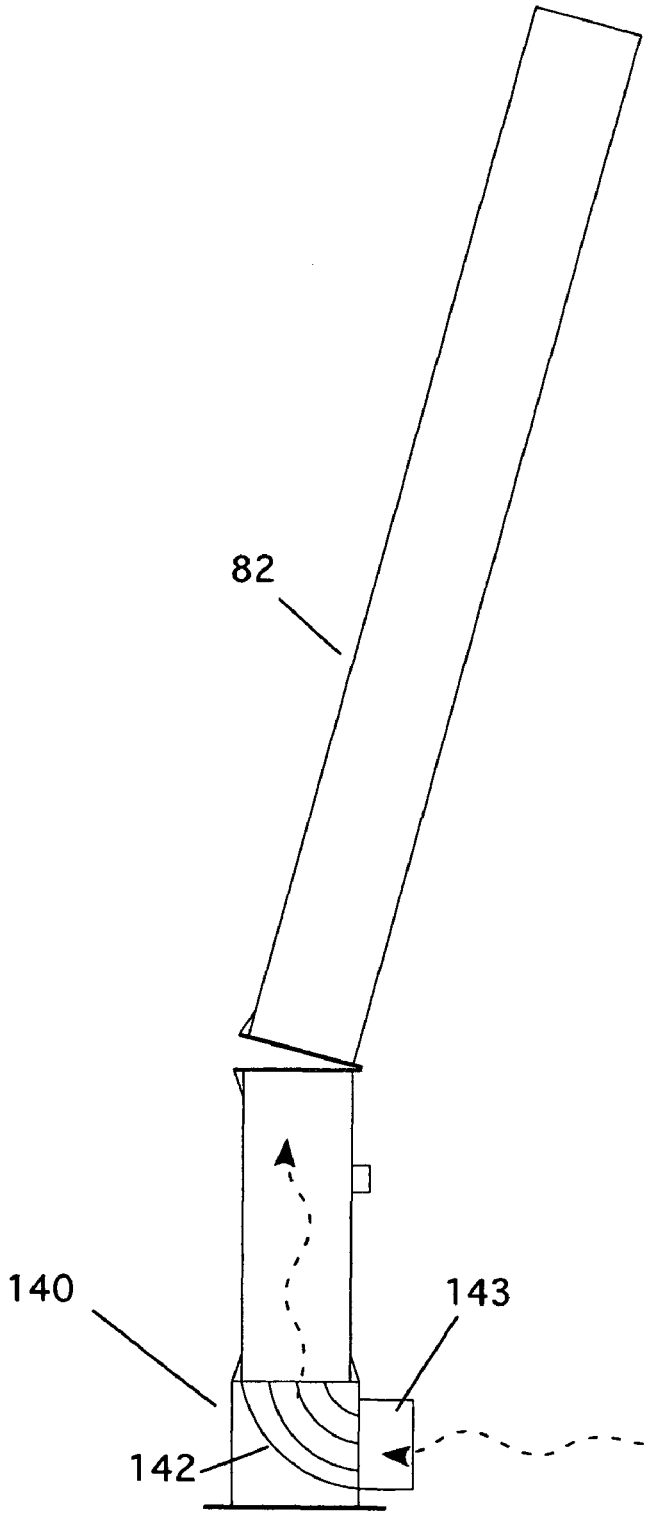
FIG. 7 is a side detail of the stack showing the flow-diverter and straightening chamber located at the stack base.

Finally, a stack support 92 is used to support the exhaust structure, as shown and a stack cradle 38 is used to hold the stack when it is folded down for transport (see, e.g., FIG. 7, which shows the stack 82 being tilted into a horizontal position for transport.

As noted, these components are housed on a double axle trailer chassis 200 with tires 201. The chassis and details are shown in FIGS. 2-4.

Figure 2:
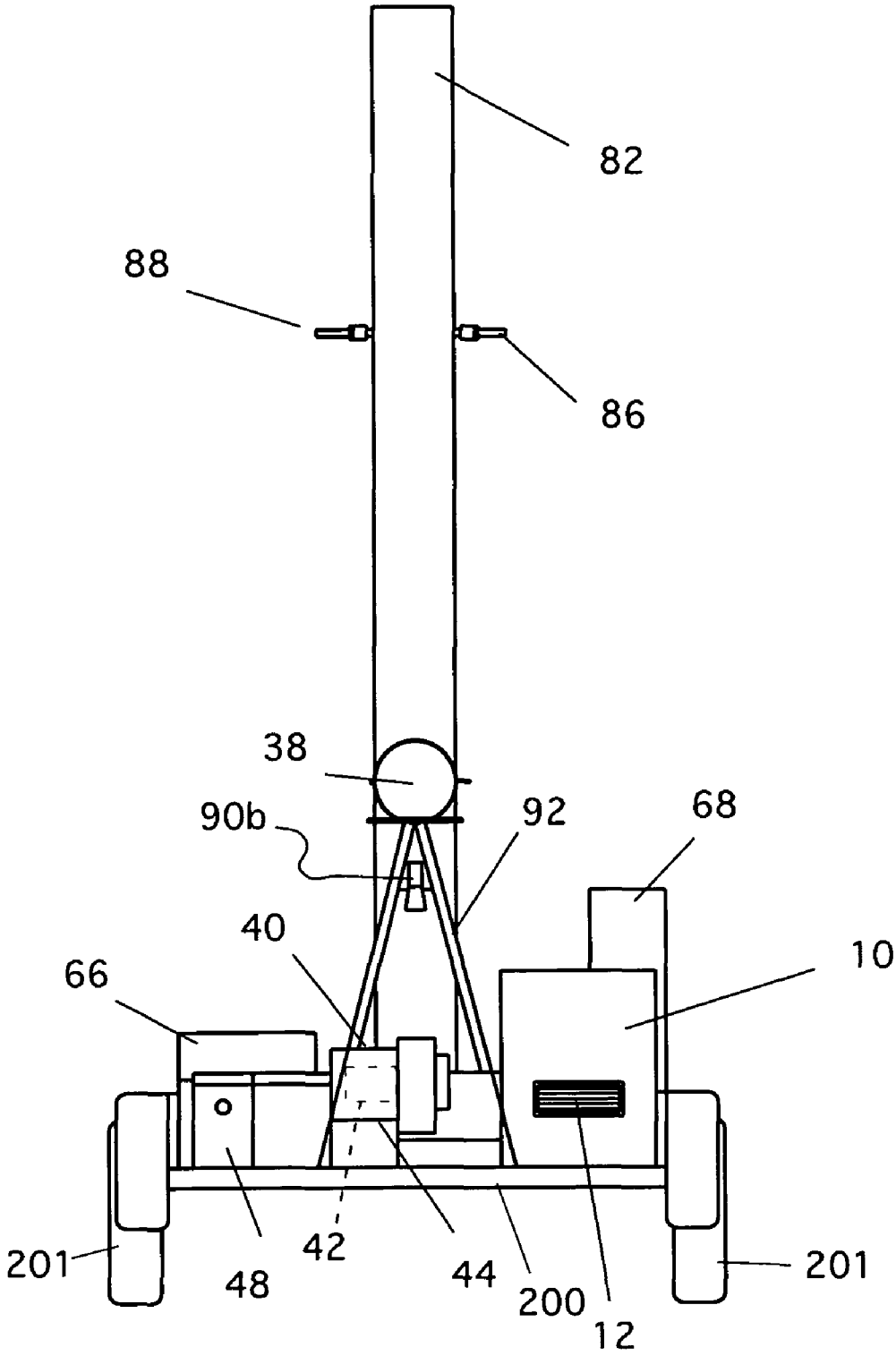
FIG. 2 is a front view of the assembled unit.

FIG. 2 is a front view of the assembled unit. Here, various components are shown. The stack 82, the opacity monitor sender unit 86, and an opacity monitor receiver unit 88 are shown extending upward from the chassis. On the right side, the control panel 68 is shown behind the black smoke generator 10 and the black smoke generator air inlet louvers 12. In the center is the stack support 92. Also shown are the main fan 40, and fan motor cover 44. On the left side are the white smoke generator chamber 48 and the storage compartment 66.

Figure 3:
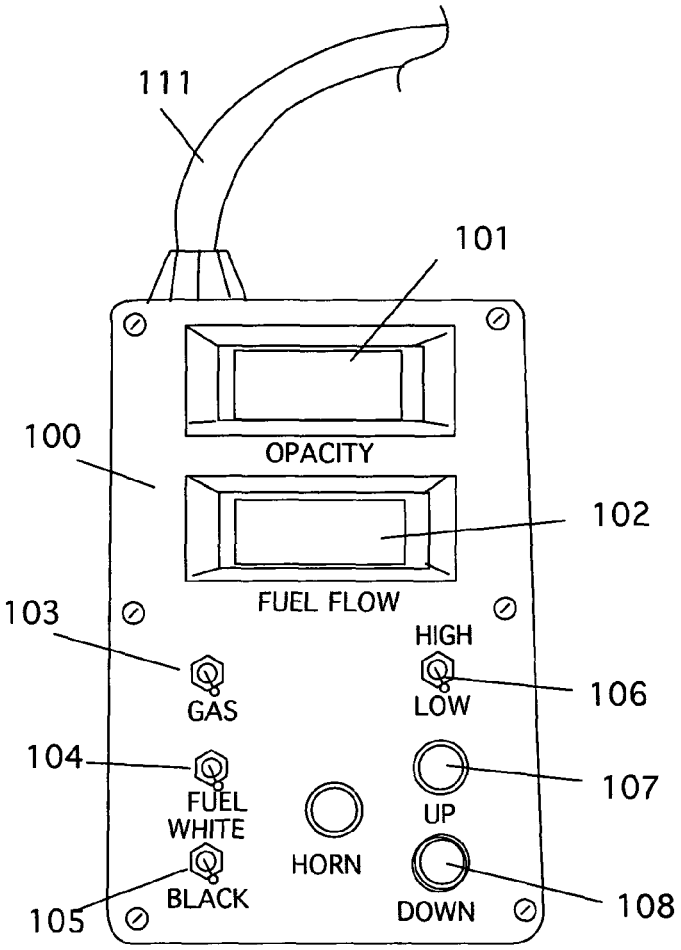
FIG. 3 is a detail of the remote control unit.
Figure 3A:
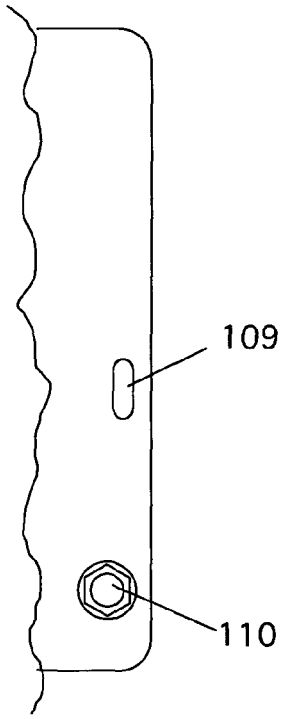
FIG. 3*a* is a partial side view of the remote control unit.
Figure 4:
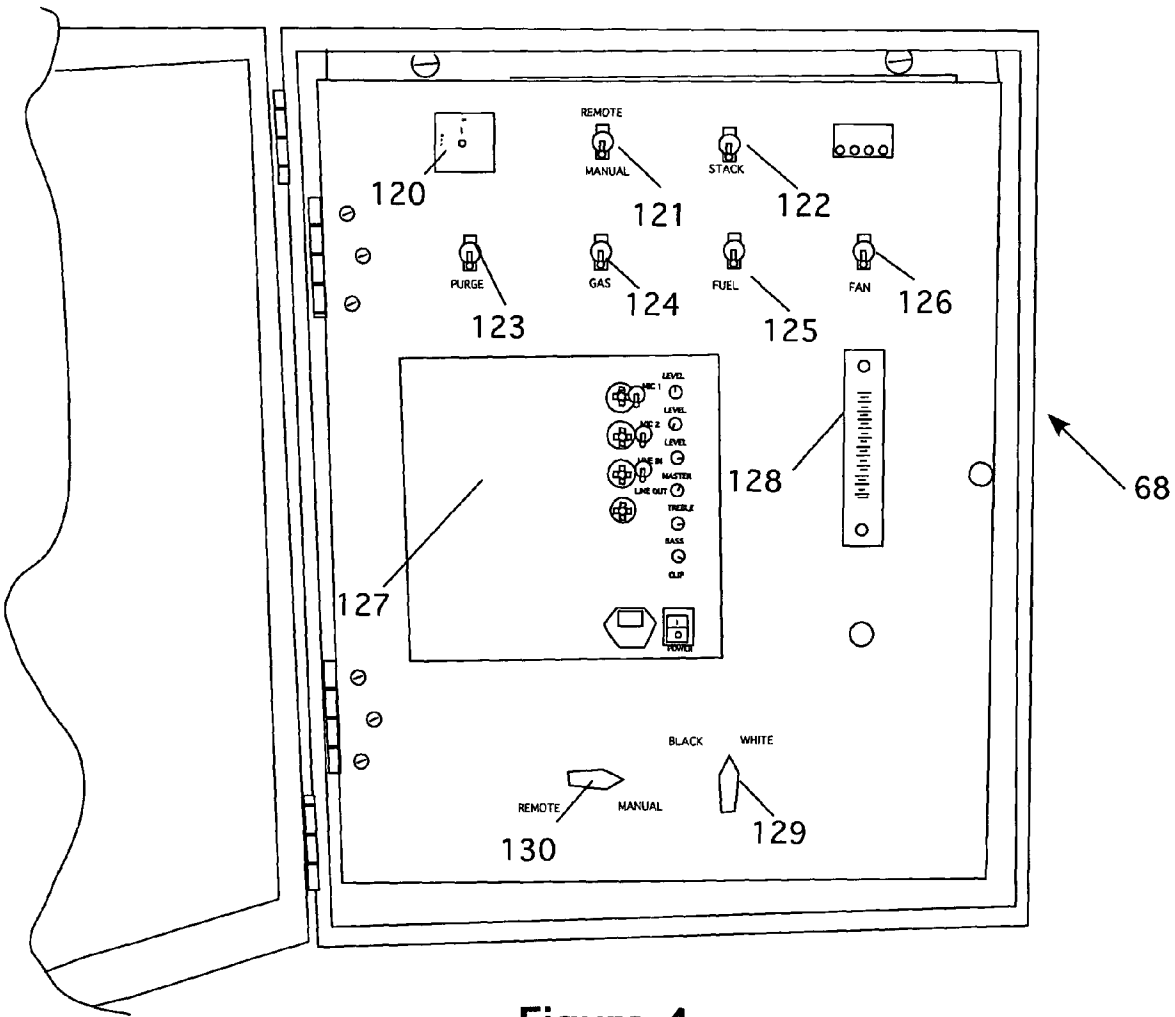
FIG. 4 is a detail of the control panel.

FIG. 3 is a detail of the remote control unit 100. FIG. 3*a* is a detail of the side of the remote unit. Because the unit is used for training, the instructor can operate the basic controls remotely. This allows the instructor to directly address the students during training exercises. On the front of the remote control, there is an opacity screen LED 101 that reads the opacity of the smoke from the opacity sensor. Below that, there is a fuel flow screen LED 102 that reads the percent open of the fuel flow valve being used at the time. A gas toggle switch 103 turns the propane valve on or off. A fuel toggle switch 104 turns the fuel being used at the time on or off. A white/black smoke toggle switch 105 turns the fuel flow valve for black smoke on and the fuel flow valve for white smoke off, or vise versa. A high/low valve speed toggle switch 106 changes the rate at which the fuel valve selected by the white/black switch opens and closes. The fuel valve up/down buttons 107, and 108 control whether the valve is opening (up) or closing (down). The remote control is connected to the main control panel 68 (see e.g., FIGS. 1 and 2) through a cable 111.

FIG. 3*a* shows a partial side view of the remote unit. A data acquisition port 109 is installed, which allows transmitting the opacity readings to a data acquisition device for recording the opacity at the time students are observing the opacity during each test reading period. A microphone jack 110 is also installed, which allows the operator to speak through a microphone to the students FIG. 4 is a detail of the control panel 68. Here, the basic controls of the system are shown. They include the on/off switch 120, the remote/manual switch 121, a stack switch 122 (used to raise and lower the stack), a purge switch 123, a gas switch 124, a fuel switch 125, and a fan switch 126. Below the switches is a communications box 127 that allows up to three microphones to be connected for outdoor classes. (Because the unit produces smoke, classes are held outdoors, as such, the instructors use the communication system to teach the class). A fuel flow meter (rotameter) 128, a valve to change from black to white smoke 129 and a second remote/manual valve 130 are shown as well.

One of the biggest innovations in this device is the development of a new black smoke generator 10. The design generates black smoke without using toluene. As discussed above, this increases the safety of the device. The black smoke combustion chamber is mounted in the rear of the generator. It has two chambers (front and back). Diesel fuel is used to produce black smoke within the chamber. It is constructed of two steel shells. It is insulated between both shells and lined with firebrick on the inside of the front chamber to promote even reaction temperatures and better burn control. The intake air inlet is equipped with louvers that can be adjusted to direct the combustion air into the combustion chamber at variable air flow angles to influence the combustion efficiency and to maximize the degree of black smoke generation. The geometry of the smoke chamber and the intake air louvers are set to promote maximum black smoke generation. Once the system has been sufficiently warmed up (using propane), the rate of fuel flow determines the density of the black smoke plume. The pilot light can be adjusted with an external control valve located next to the smoke chamber.

Figure 5:
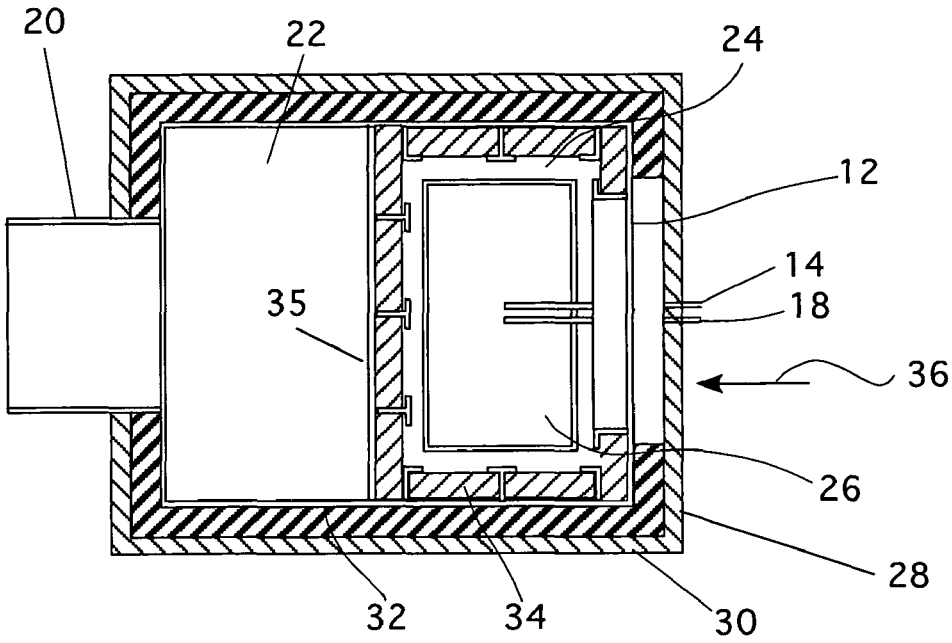
FIG. 5 is a top internal view of the black smoke generator.
Figure 6:
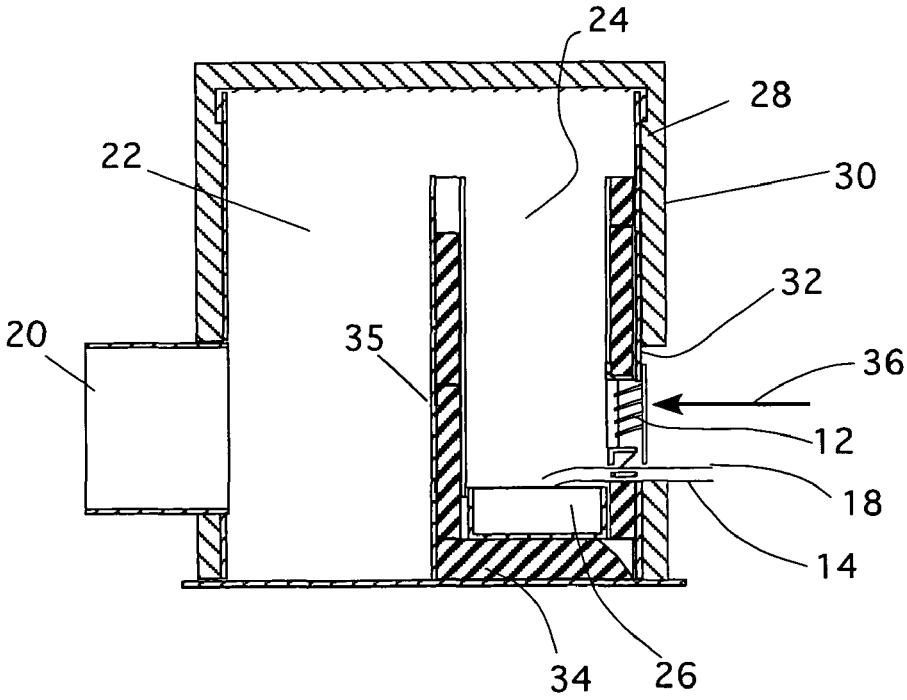
FIG. 6 is a left side internal view of the black smoke generator.

FIGS. 5 and 6 show internal details of the black smoke generator. FIG. 5 is a top internal view of the black smoke generator. FIG. 6 is a front internal view of the black smoke generator. The black smoke generator back chamber 22, the black smoke generator front chamber 24, and the fuel pan 26 are shown. A layer of insulation 28 is positioned around the unit as shown. The black smoke generator outer shell 30 and inner shell 32, as well as the placement of firebrick 34 are also shown. FIG. 6 shows the placement of the air intake louvers 12 as well. Finally, the output of the black smoke generator is passed through the black smoke duct 20, located at the rear of the unit.

It was an unexpected and synergistic result that the specific dimensions of the black smoke chamber enable it to produce black smoke when only diesel fuel is burned in it. Because it has been discovered that some dimensional configurations do not produce black smoke, it is now expected that only specific inside dimensions do produce black smoke. Thus, in the preferred embodiment the inside dimensions of the chamber that are critical to producing black smoke with only diesel fuel are: the rectangular combustion air inlet 12 has an opening 12 inches wide by 4 inches high.

The black smoke generator chamber overall is 19.5 inches wide by 24 inches deep by 28.75 inches high. The black smoke generator is separated into front and back chambers by a ¼-inch sheet of steel 35, which is 19.5 inches wide by 24 inches high. The front chamber is 19.5 inches wide by 13 inches deep with a flue path 4.75 inches over the top of the sheet steel separating the two chambers. The front chamber is lined with 1.25-inch thick firebrick to a height of 24 inches in the front of the chamber, and 20.5 inches on the sides and back of the chamber. The front chamber is also lined with two thicknesses of the same brick 34 on the bottom of the chamber. The back chamber is 19.5 inches wide by 10.75 inches deep by 28.75 inches high. The black smoke duct in the rear of the back chamber has a 10.00-inch outside diameter.

As discussed above, white smoke is produced in the white smoke generator. This is done by first evaporating and subsequently condensing distillate type oil (most commonly a #2 diesel fuel) into an aerosol cloud. This cloud is white and its opacity varies in proportion to the volume of oil vaporized. By altering the fuel flow to the burn chambers, the operator controls the visual densities (opacity) of the plume. A propane-fired vaporization chamber supplies the heat of evaporation. The vaporization chamber is located at the rear of the smoke generator. A propane fired burner nozzle at the front of the white smoke chamber supplies the evaporative heat. As discussed above, the propane is stored in two independent gas cylinders that can be individually tied in to the system. A pressure regulator provides even gas flow. A remote-control solenoid shutoff valve is provided in line with the pressure regulator. The switches for the shutoff valve are located on the main control panel and on the remote control unit (if provided).

The white smoke chamber includes an automatic temperature control circuit in order to maintain fuel evaporation chamber temperatures between 700 and 900 degrees F. It is this temperature control that is the novel enhancement to the white-smoke chamber, allowing continuous production of white smoke. In previous white-smoke generators white smoke production would occasionally fail because the white smoke chamber would cool down. The addition of a temperature control circuit solves the problem of having to delay training until the temperature for the white smoke chamber is again high enough to produce white smoke.

The primary fan system consists either of a radial fan unit with a 110 VAC motor with a 0.5 hp nominal output rating or an axial (propeller-type) fan and a 12-VDC motor with a 19 AMPS or 0.3 hp rating. A fan-speed controller is optional and can be operated from the central control console. It is also possible to operate the system with both an AC- and a DC-system to increase its range of operation by allowing the system to be used in a remote location where there is no access to line power.

The exhaust gases from both smoke generator chambers are drawn into the intake manifold by vacuum from the main induced-draft fan(s) located in the center rear of the smoke generator. The intake manifold acts as a mixing chamber. The exhaust gasses are routed from the common duct through a series of flow-straightening vanes while making the 90-degree turn into the vertical portion of the smoke stack. The design of the flue-gas architecture was specifically chosen in order to promote laminar flow and to minimize the characteristic "puffing" of traditional smoke generator units. The overall stack height from ground to stack tip is about 15 feet. The smoke stack pivots on a hinge so that it can lie flat for transport and storage. The stack can be raised and lowered with either electric or hydraulic actuators. A switch on the control panel controls the raising and lowering of the stack.

Figure 8:
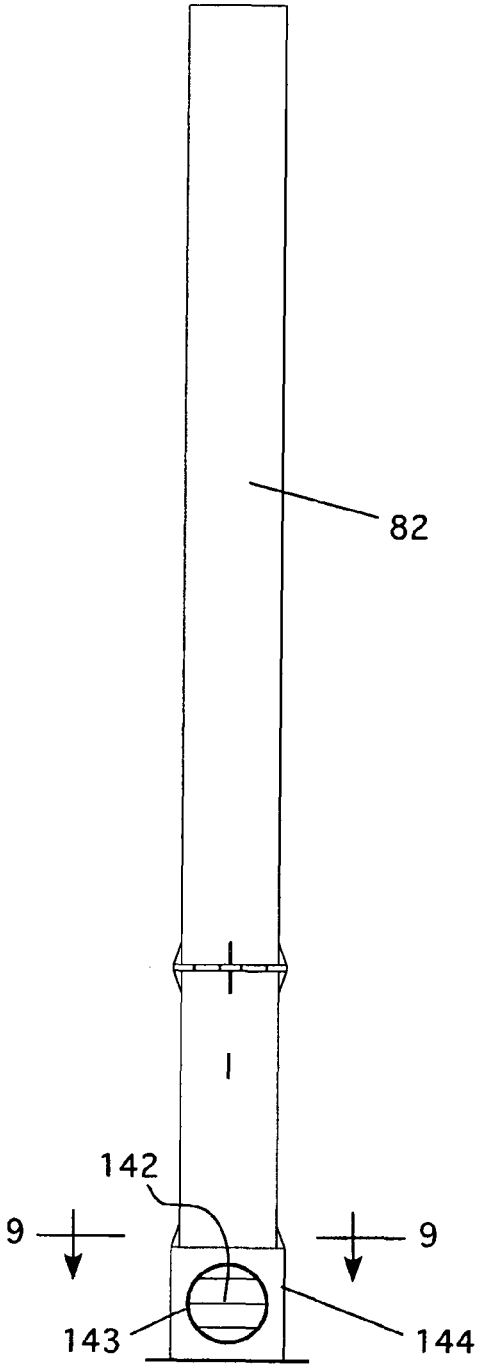
FIG. 8 is a front detail of the stack showing the flow-diverter and straightening chamber located at the stack base.

As discussed above, the invention includes a flow-diverter and straightening chamber 140 located at the stack base 144 to establish a smooth transition from horizontal duct flow to the vertical exhaust stack flow. The stack 82 and chamber 140 are shown in FIG. 7. Within the flow diverter and straightening chamber 140 are a series of flow straightening vanes 142 that curve upward to direct exhaust gases entering through the inlet 143 from the horizontal to the vertical direction (see arrows). Note, FIG. 7 shows the stack partially tilted for storage. The stack is typically rotated into a horizontal position for transport and is secured sack cradle 38. FIG. 8 is a front detail of the stack 82 showing the flow-diverter and straightening chamber 140 and the vanes 142 positioned behind the inlet 143.

Figure 9:
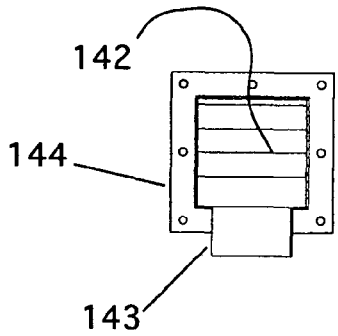
FIG. 9 is a top sectional view of the flow-diverter and straightening chamber taken along the lines 9-9 of FIG. 8.

FIG. 9 is a top sectional view of the flow-diverter and straightening chamber taken along the lines 9-9 of FIG. 8. Here, the vanes 142 are shown positioned within the stack base 144. Note also the inlet 143.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A black smoke generator for use with a visible emissions training smoke generating system comprising:

a) a back chamber;

b) a front chamber, having a bottom, said front and back chambers forming an overall chamber;

c) a fuel pan, installed in said front chamber;

d) an air intake louver, installed in said front chamber; and e) a black smoke duct, installed in the rear of said back chamber;

f) wherein said black smoke generator produces black smoke using propane and diesel fuel only.

2. The black smoke chamber of claim 1 wherein the air inlet louver has an opening that is 12 inches wide by 4 inches high.

3. The black smoke generator of claim 2 wherein the black smoke generator has overall chamber dimensions of 19.5 inches wide by 24 inches deep by 28.75 inches high.

4. The black smoke generator of claim 3 wherein the front and back chambers are separated by a sheet of steel 19.5 inches wide by 24 inches high, such that a flue path 4.75 inches exists over the top of the sheet steel separating the two chambers.

5. The black smoke generator of claim 4 wherein front chamber is lined with 1.25-inch thick firebrick to a height of 24 inches in the front of the chamber, and 20.5 inches on the sides and back of the front chamber.

6. The black smoke generator of claim 5 wherein the front chamber also has two thicknesses of firebrick on the bottom of the chamber.

7. The black smoke generator of claim 6 wherein the back chamber is 19.5 inches wide by 10.75 inches deep by 28.75 inches high.

8. The black smoke generator of claim 7 wherein the black smoke duct has an outside diameter of 10.00 inches.

9. The black smoke generator of claim 1 further comprising a visible emissions training system.

10. The visible emissions training system of claim 9 including:

a) a chassis upon which said black smoke generator is placed;

b) a white smoke generator, attached to said chassis, said white smoke generator having a white smoke duct;

c) an air handling system attached to said white smoke and said black smoke ducts;

d) an exhaust stack, attached to said air handling system;

e) means for supplying propane to said white and black smoke generators, attached to said chassis;

f) means for supplying diesel fuel to said white and black smoke generators, attached to said chassis; and g) a control panel to operate said visible emissions training system.

11. The visible emissions training system of claim 10 wherein the air handling system includes an induced draft injector dilution air system.

12. A visible emissions training smoke generating system comprising:

a) a chassis;

b) a black smoke generator installed on said chassis, said black smoke generator including:

i) a back chamber;

ii) a front chamber, having a bottom, said front and back chambers forming an overall chamber;

iii) a the fuel pan, installed in said front chamber;

iv) an air intake louver, installed in said front chamber; and v) a black smoke duct, installed in the rear of said back chamber;

c) wherein said black smoke generator produces black smoke using propane and diesel fuel only;

d) a chassis upon which said black smoke generator is placed;

e) a white smoke generator, attached to said chassis, said white smoke generator having a white smoke duct;

f) an air handling system attached to said white smoke and said black smoke ducts;

g) an exhaust stack, attached to said air handling system;

h) means for supplying propane to said white and black smoke generators, attached to said chassis;

i) a control panel to operate said visible emissions training system;

j) an opacity monitor sender unit; installed on said chassis and being in operable communication with said smoke generating system; and k) an opacity monitor receiver unit installed on said chassis and being in operable communication with said smoke generating system.

13. The black smoke chamber of claim 12 wherein the air inlet louver has an opening that is 12 inches wide by 4 inches high.

14. The black smoke generator of claim 12 wherein the black smoke generator overall chamber 19.5 inches wide by 24 inches deep by 28.75 inches high.

15. The black smoke generator of claim 12 wherein the front and back chambers are separated by a sheet of steel 19.5 inches wide by 24 inches high, such that a flue path 4.75 inches exists over the top of the sheet steel separating the two chambers.

16. The black smoke generator of claim 12 wherein the front chamber is lined with 1.25-inch thick firebrick to a height of 24 inches in the front of the chamber, and 20.5 inches on the sides and back of the front chamber.

17. The black smoke generator of claim 16 wherein the front chamber also has two thicknesses of firebrick on the bottom of the chamber.

18. The black smoke generator of claim 17 wherein the back chamber is 19.5 inches wide by 10.75 inches deep by 28.75 inches high.

19. The black smoke generator of claim 18 wherein the black smoke duct has an outside diameter of 10.00 inches.

20. The visible emissions training system of claim 12 wherein the air handling system includes an induced draft injector dilution air system.

* * * * *